US008270852B2

(12) United States Patent
Ando et al.

(10) Patent No.: US 8,270,852 B2
(45) Date of Patent: Sep. 18, 2012

(54) RECLAIMED MATERIAL CONTAINER AND IMAGE FORMING APPARATUS

(75) Inventors: Hiroki Ando, Ebina (JP); Tomonori Sato, Ebina (JP); Fumiaki Maekawa, Ebina (JP); Satoshi Honobe, Ebina (JP); Toshiyuki Matsui, Ebina (JP); Tsuneo Fukuzawa, Ebina (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 276 days.

(21) Appl. No.: 12/826,345

(22) Filed: Jun. 29, 2010

(65) Prior Publication Data

US 2011/0103824 A1 May 5, 2011

(30) Foreign Application Priority Data

Oct. 29, 2009 (JP) ..... 2009-248701

(51) Int. Cl.
*G03G 15/00* (2006.01)
*G03G 15/08* (2006.01)
*G03G 21/12* (2006.01)

(52) U.S. Cl. ..... 399/10; 399/35; 399/120; 399/360

(58) Field of Classification Search ..... 399/10, 399/24, 25, 35, 120, 358–360; 222/DIG. 1
See application file for complete search history.

(56) References Cited

U.S. PATENT DOCUMENTS

| | | | | |
|---|---|---|---|---|
| 7,245,868 | B2 * | 7/2007 | Arai | 399/360 |
| 7,620,358 | B2 * | 11/2009 | Kadowaki et al. | 399/358 |
| 2009/0097879 | A1 * | 4/2009 | Nagashima et al. | 399/120 |

FOREIGN PATENT DOCUMENTS

| | | | |
|---|---|---|---|
| JP | 2006-276022 | A | 10/2000 |
| JP | 2006-011360 | A | 1/2006 |

* cited by examiner

*Primary Examiner* — Hoan Tran
(74) *Attorney, Agent, or Firm* — Sughrue Mion, PLLC

(57) ABSTRACT

A reclaimed material container includes a container body that is removably mounted to a mounting portion of an image forming apparatus, and that accommodates a reclaimed material existing after forming an image, a receiving portion that is provided at a bottom portion of the container body, and that is supported by a support of the mounting portion from therebelow, and a mounting member that mounts the container body to the mounting portion as a result of rotation of the container body with the receiving portion as a fulcrum while the receiving portion is supported by the support from therebelow. In the container, the container body has a first recess that provides a field of view for the support when the receiving portion is supported by the support from therebelow.

6 Claims, 17 Drawing Sheets

RECLAIMED MATERIAL CONTAINER AND IMAGE FORMING APPARATUS

CROSS-REFERENCE TO RELATED APPLICATIONS

This application is based on and claims priority under 35 USC 119 from Japanese Patent Application No. 2009-248701 filed Oct. 29, 2009.

BACKGROUND (i) Technical Field

The present invention relates to a reclaimed material container and an image forming apparatus.

(ii) Related Art

It is known to provide an image forming apparatus that includes a toner reclaim bottle for a toner that is reclaimed from an image carrier by cleaning a non-transferred toner on the image carrier.

SUMMARY

According to an aspect of the invention, there is provided a reclaimed material container including a container body that is removably mounted to a mounting portion of an image forming apparatus, and that accommodates a reclaimed material existing after forming an image; a receiving portion that is provided at a bottom portion of the container body, and that is supported by a support of the mounting portion from therebelow; and a mounting member that mounts the container body to the mounting portion as a result of rotation of the container body with the receiving portion as a fulcrum while the receiving portion is supported by the support from therebelow. In the container, the container body has a first recess that provides a field of view for the support when the receiving portion is supported by the support from therebelow.

BRIEF DESCRIPTION OF THE DRAWINGS

Exemplary embodiments of the present invention will be described in detail based on the following figures, wherein.

DETAILED DESCRIPTION

An exemplary embodiment of the present invention will hereunder be described.

Figure 1:
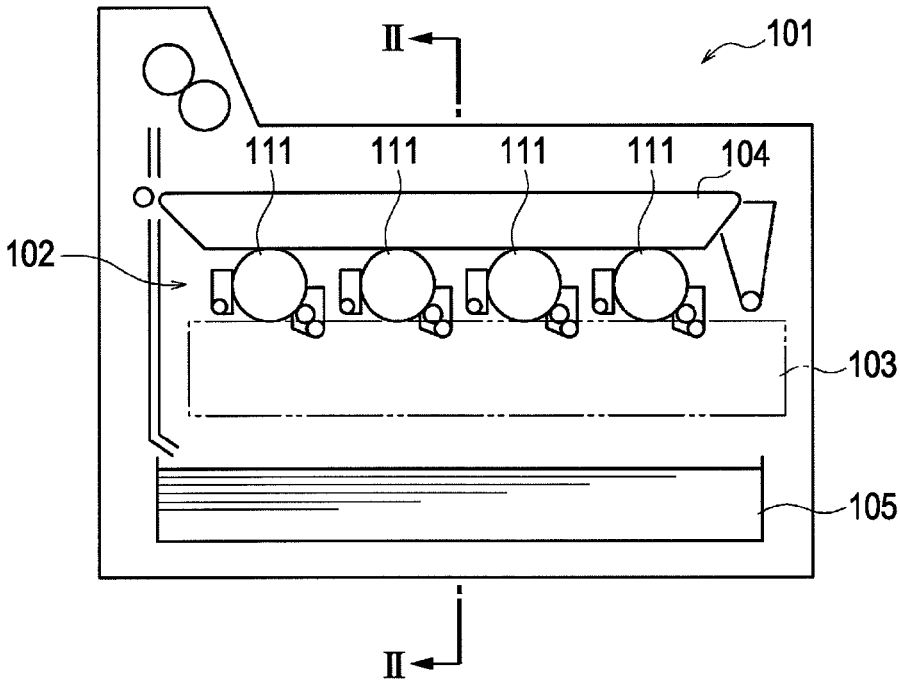
FIG. 1 illustrates an image forming apparatus according to an exemplary embodiment of the present invention.
Figure 2:
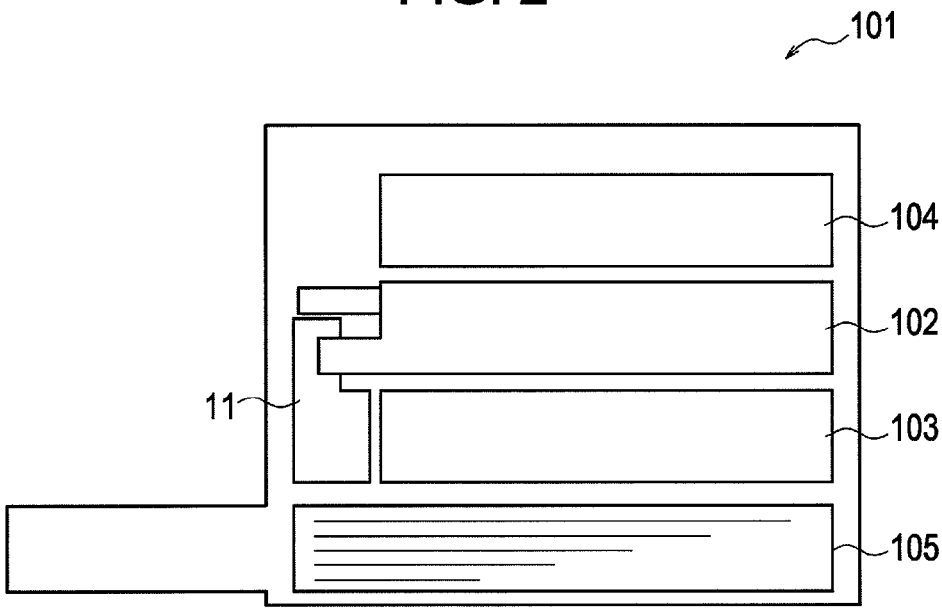
FIG. 2 is a sectional view taken along line II-II of FIG. 1 of the image forming apparatus according to the exemplary embodiment of the present invention.

FIG. 1 illustrates an image forming apparatus 101 according to an exemplary embodiment of the present invention. FIG. 2 is a sectional view taken along line II-II of FIG. 1.

The image forming apparatus 101 includes a photosensitive unit 102, an exposure device 103, and an intermediate transfer body, used for forming an image on a print medium, such as paper, by an electrophotographic system. The photosensitive unit 102 includes photosensitive members 111 for forming toner images of respective colors, yellow (Y), magenta (M), cyan (C), and black (K). The exposure device 103 forms latent images of the respective colors, Y, M, C, and K, on the respective photosensitive members 111, to develop the latent images with toner. The toner images after the development are transferred onto the intermediate transfer body 104 by a transfer unit so that the colors Y, M, C, and K are superposed upon each other. Sheets, which are print media, are stacked and held in a sheet container 105, and the toner images transferred to the intermediate transfer body 104 are formed on the sheet.

Reclaimed material, such as toner remaining on the photosensitive members 111 after forming the image, is removed by a cleaning device. Reclaimed material remaining on the transfer unit is removed by a transfer cleaning device. The reclaimed materials include residual developer (toner and external additive), foreign matter (such as dust on the photosensitive members produced from a sheet (print medium)), and lubricant applied to the photosensitive members.

Such reclaimed materials that have been removed are accommodated and accumulated in a collecting container 11. The collecting container 11 is removably mounted in the image forming apparatus 101. When the collecting container 11 is filled with the reclaimed materials, the collecting container 11 is replaced with a new one.

Figure 3:
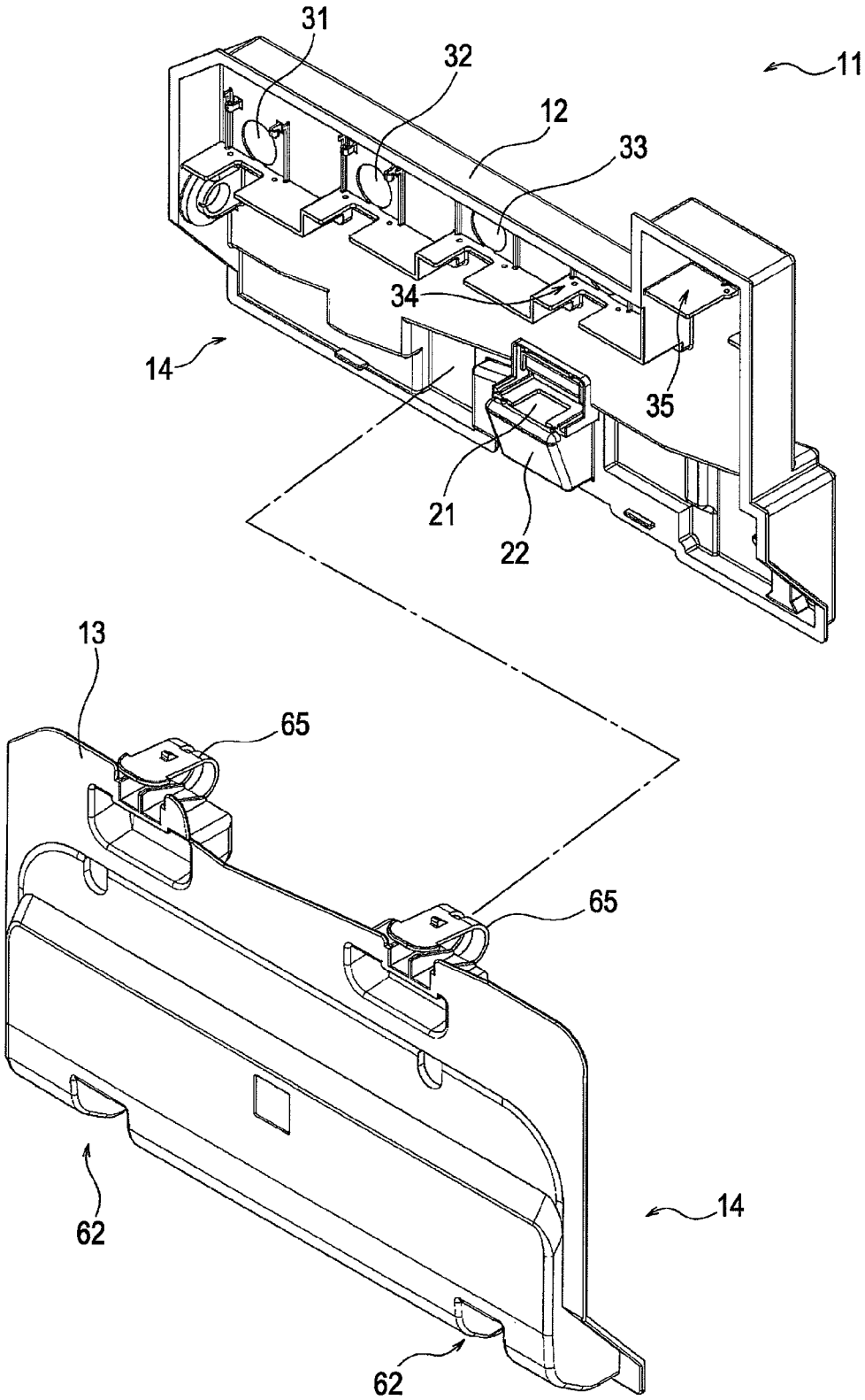
FIG. 3 is an exploded perspective view of a reclaimed material container according to an exemplary embodiment of the present invention.

FIG. 3 is an exploded perspective view of a reclaimed material container 11.

The reclaimed material container 11 includes two housings 12 and 13 (front housing 13 and rear housing 12). The housings 12 and 13 are removable from each other. When the housings 12 and 13 are fitted to each other, a container body according to an exemplary embodiment of the present invention is realized. An accommodation chamber 14 is formed in the container body. In FIG. 3, some members in the accommodation chamber 14 are not shown. Reclaimed material after forming an image with a printer engine 1 serving as an exemplary image forming unit is held and accumulated in the accommodation chamber.

Figure 4:
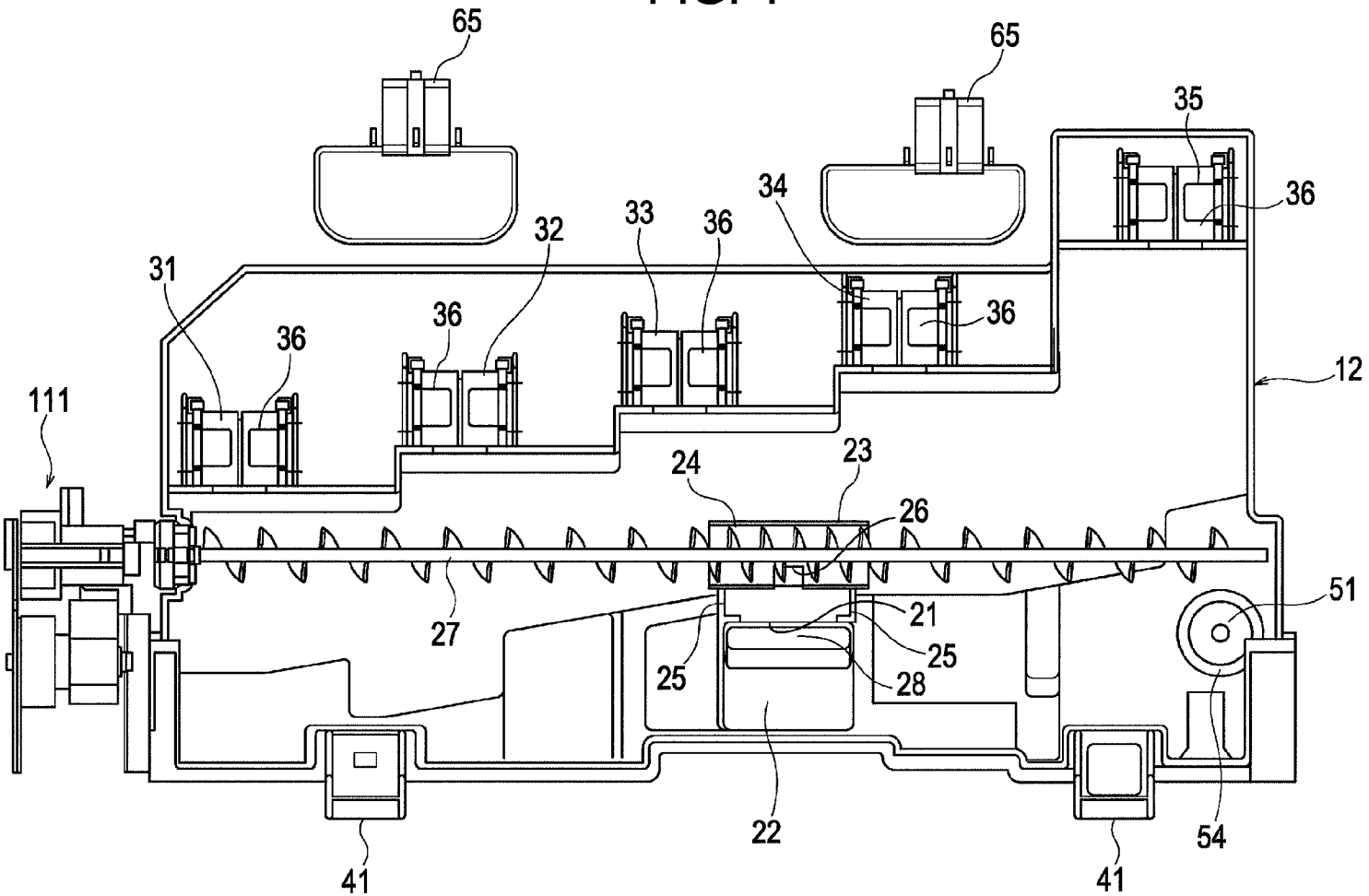
FIG. 4 is a plan view of the vertically divided reclaimed material container according to the exemplary embodiment of the present invention as seen from a side of an accommodation chamber.

FIG. 4 is a plan view of the vertically divided reclaimed material container 11 as seen from a side of an accommodation chamber 14.

Five openings 31 to 35 are formed in an upper portion of the housing 12 in a step arrangement, and are disposed horizontally. Doors 36 that are capable of being opened and closed are provided in the respective openings. Reclaimed material collected by the cleaning device from the photosensitive member that forms a K image is dropped into the accommodation chamber 14 from the opening 31. Reclaimed material collected by the cleaning device from the photosensitive member that forms a C image is dropped into the accommodation chamber 14 from the opening 32. Reclaimed material collected by the cleaning device from the photosensitive drum that forms a M image is dropped into the accommodation chamber 14 from the opening 33. Reclaimed material collected by the cleaning device from the photosensitive drum that forms a Y image is dropped into the accommodation chamber 14 from the opening 34. Reclaimed material removed by the transfer cleaning device is dropped into the accommodation chamber 14 from the opening 35. The reclaimed materials dropped from the openings 31 to 35 are stacked and superimposed upon each other in a pile below the openings 31 to 35 at the bottom surface in the accommodation chamber 14.

A box member 22 having an opening 21 at its upper surface is formed at the accommodation-chamber-14 side of the housing 12. A supporter 23 is removably provided above the opening 21 of the box member 22. The supporter 23 includes a cylindrical member 24, and a supporting member 25 that supports the cylindrical member 24 above the box member 22. A space between portions of the supporting member 25, and, thus, an opening 26 communicating with the opening 21 of the box member 22 are formed in a lower wall in the cylindrical member 24. The supporter 23 supports a screw feeder 27 inserted through the cylindrical member 24.

Both ends of the feeder 27 are supported at respective wall surfaces of the accommodation chamber 14 of the housing 12, and is rotationally driven by a driving mechanism 111 of the image forming apparatus 1. By rotating the feeder 27, the reclaimed material stacked and superimposed upon each other in a pile below the openings 31 to 35 at the bottom surface in the accommodation chamber 14 have average heights that are substantially equal to each other.

The interior of the box member 22 and interior of the supporter 23 form a small chamber 28. The interior of the small chamber 28 is a space used for detecting the amount of reclaimed material in the reclaimed material container 11 by an optical sensor (not shown).

Figure 5:
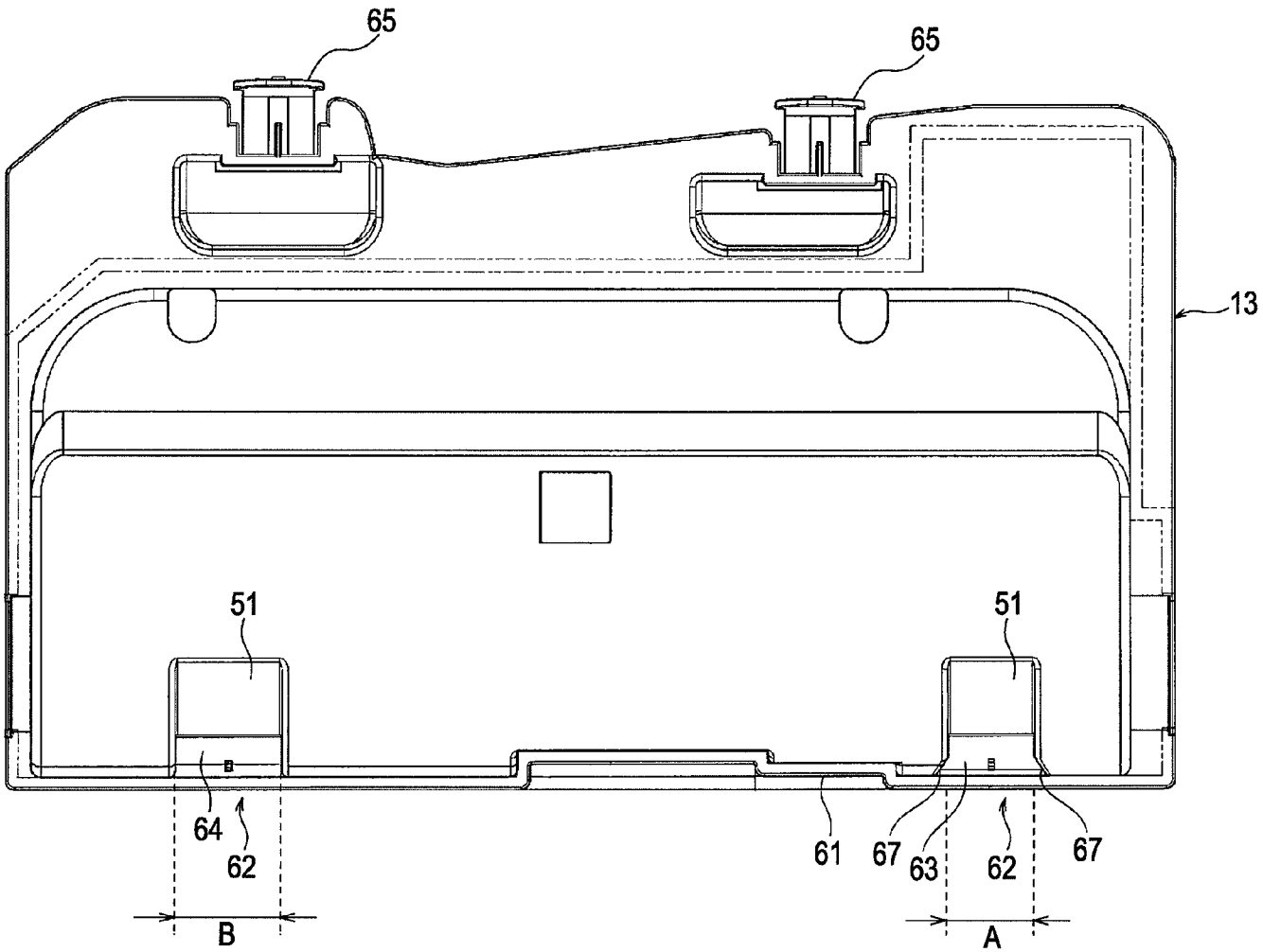
FIG. 5 is an external front view of a housing of the reclaimed material container according to the exemplary embodiment of the present invention.
Figure 6:
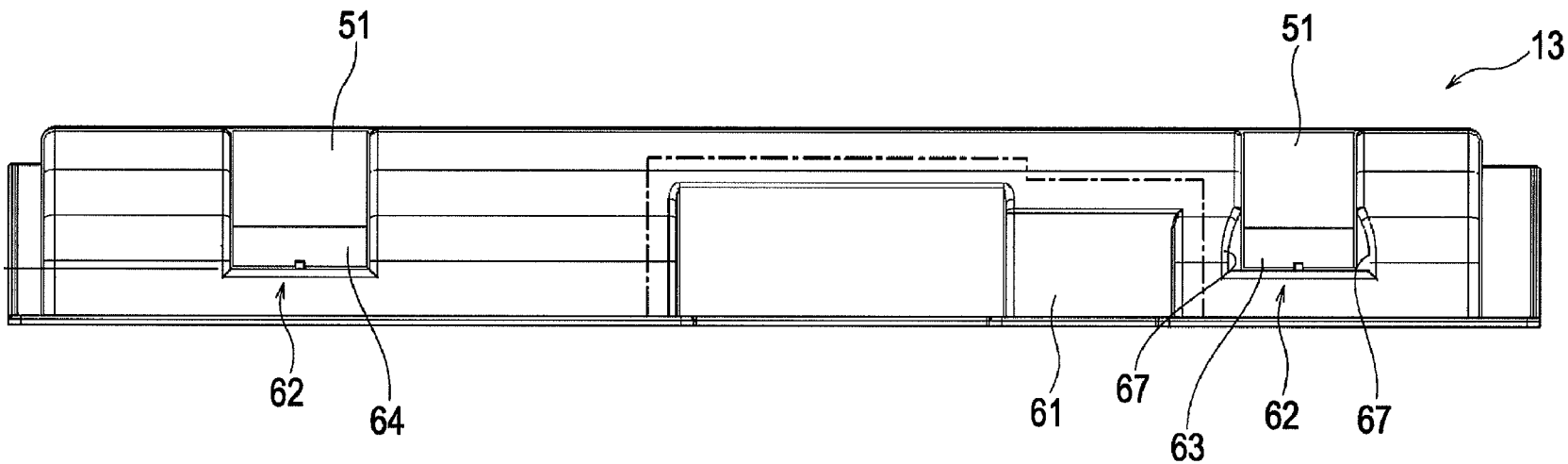
FIG. 6 is a bottom view of the housing of the reclaimed material container according to the exemplary embodiment of the present invention.

FIG. 5 is an external front view of the housing 13. FIG. 6 is a bottom view of the housing 13.

Figure 7:
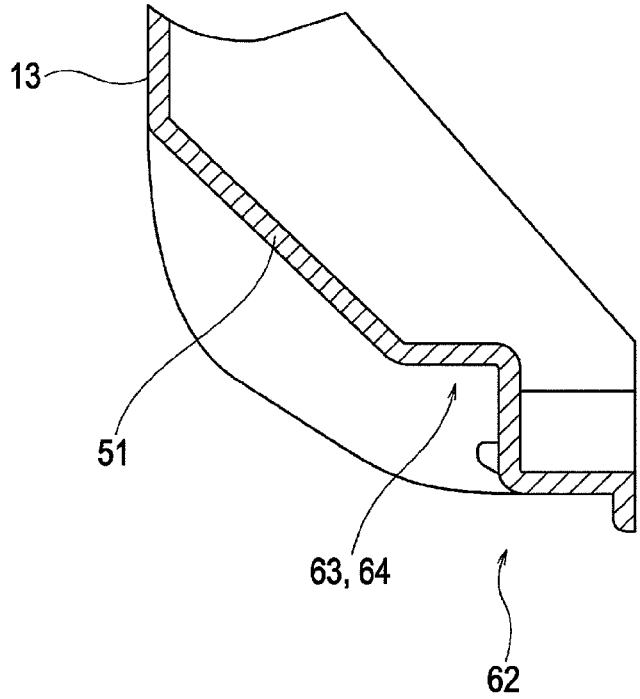
FIG. 7 is a vertical sectional view of a recess of the reclaimed material container according to the exemplary embodiment of the present invention.

When the housing 13 is viewed from the outside and from the front, a pair of left and right receiving portions 62 are formed at a bottom portion 61 of the housing 13. When the reclaimed material container 11 is mounted to a mounting portion 2, the receiving portions 62 support the reclaimed material container 11 from therebelow at supports 41 (see FIG. 8) at the mounting portion 2. Recesses 63 and 64 (serving as exemplary second recesses) are formed in the pair of left and right receiving portions 62. FIG. 7 is a vertical sectional view of the recess 63 (64).

When the housing 13 is viewed from the outside and from the front, a pair of snap members 65 (serving as an exemplary pair of left and right mounting members) are formed in upper portions of the housing 13.

Figure 8:
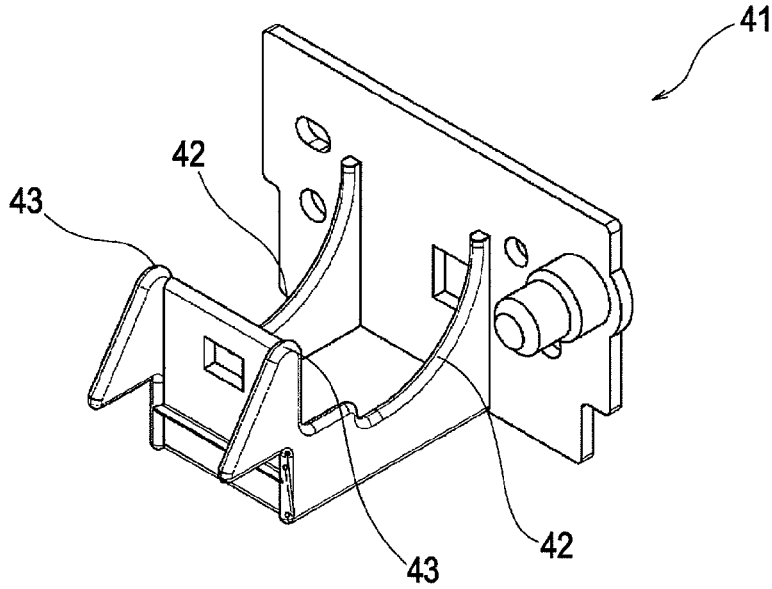
FIG. 8 is a perspective view of a support of the image forming apparatus according to the exemplary embodiment of the present invention.

FIG. 8 is a perspective view of the support 41.

The supports 41 have bases 42 that support the bottom portion 61, and protruding portions 43 that engage the recesses 63 and 64.

Figure 9:
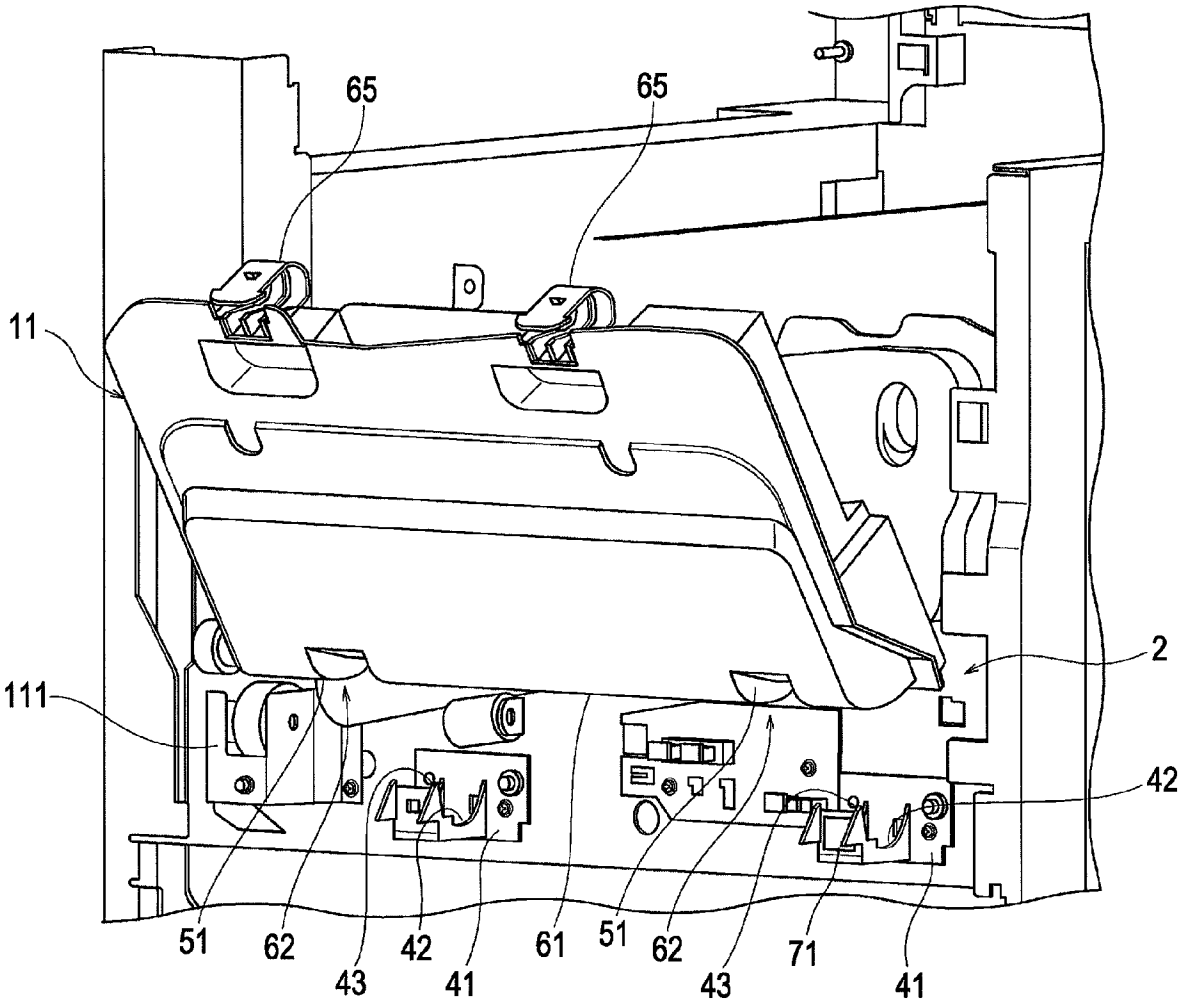
FIG. 9 is a perspective view of a stage of mounting the reclaimed material container to a mounting portion of the image forming apparatus according to the exemplary embodiment of the present invention.
Figure 10:
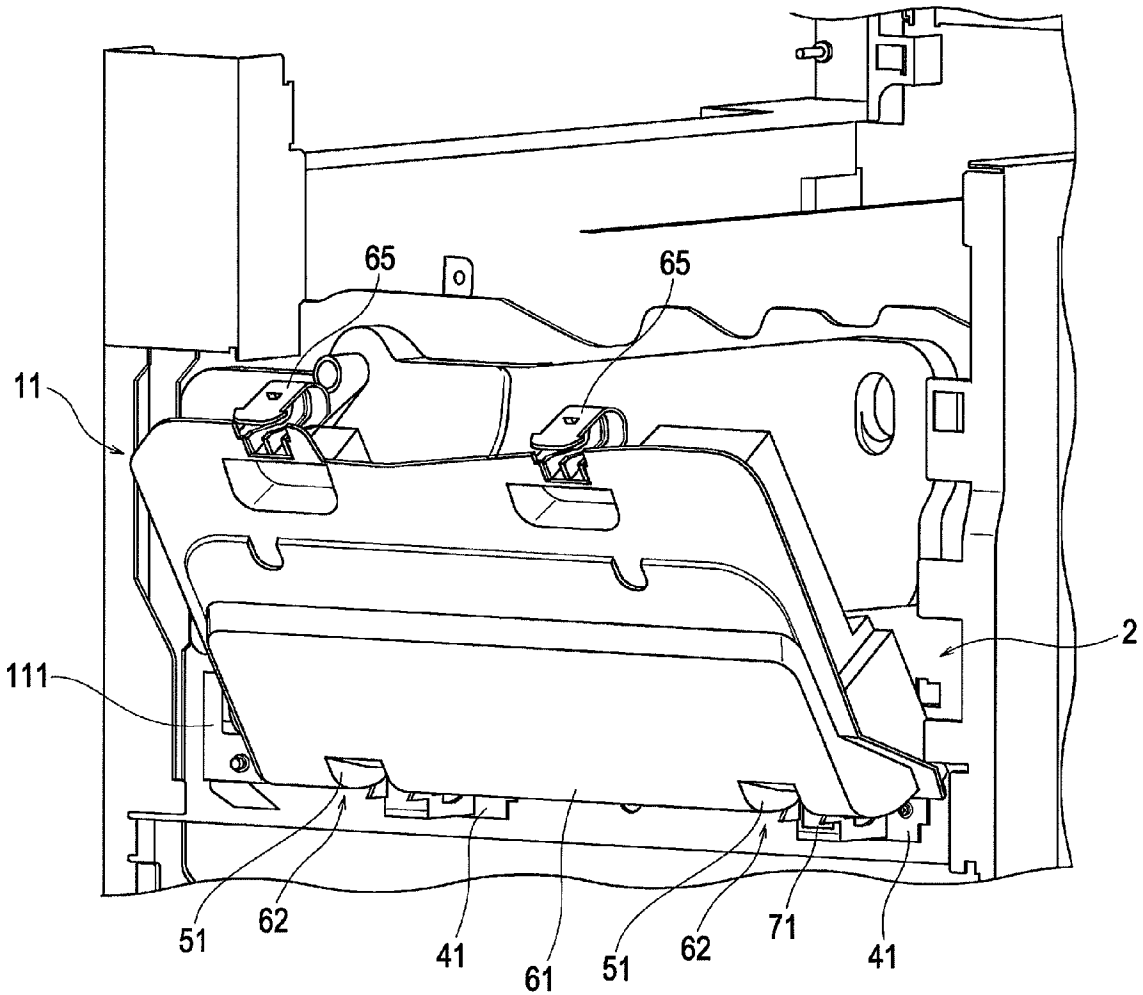
FIG. 10 is a perspective view of a stage of mounting the reclaimed material container to the mounting portion of the image forming apparatus according to the exemplary embodiment of the present invention.
Figure 11:
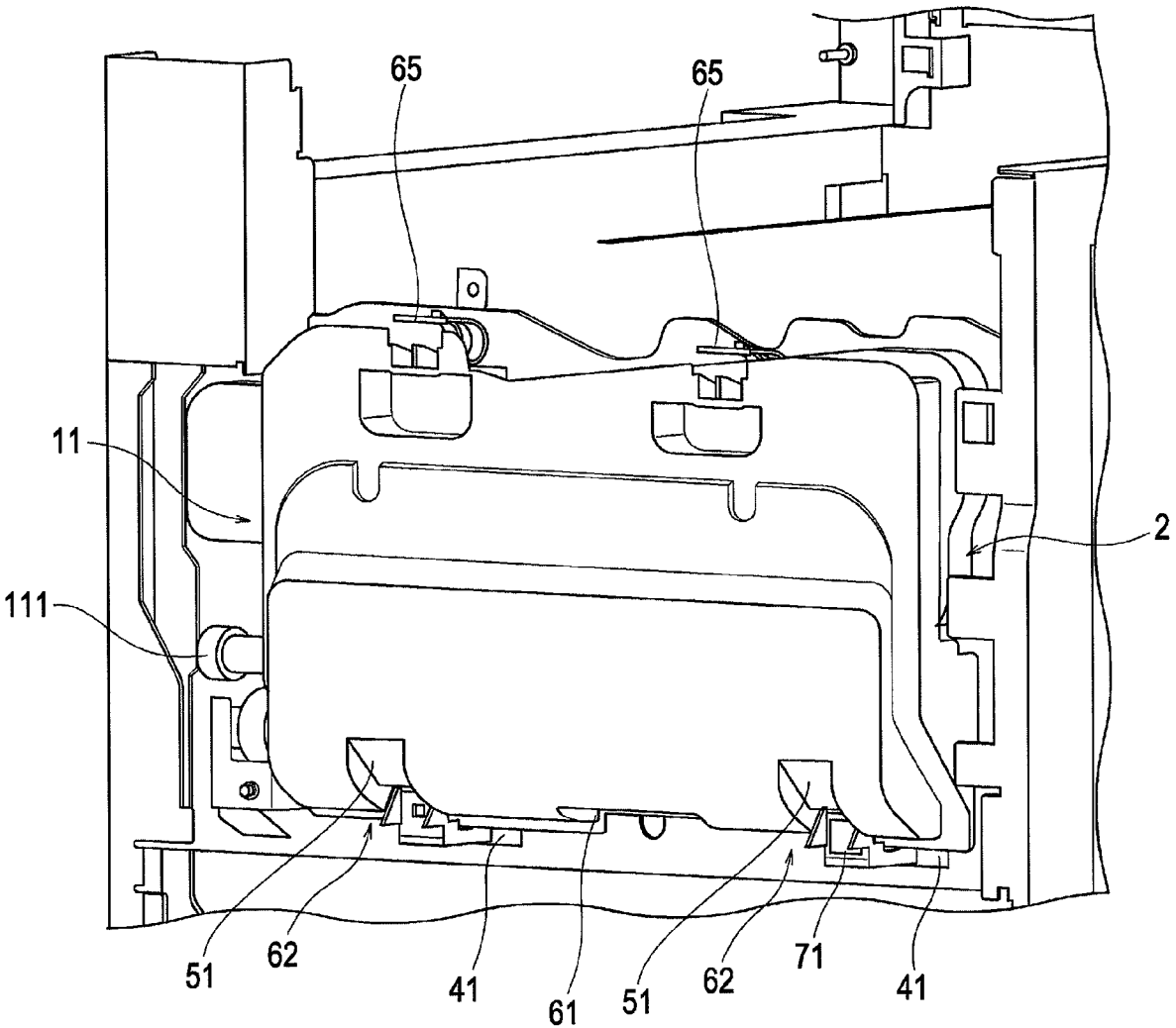
FIG. 11 is a perspective view of a stage of mounting the reclaimed material container to the mounting portion of the image forming apparatus according to the exemplary embodiment of the present invention.
Figure 12:
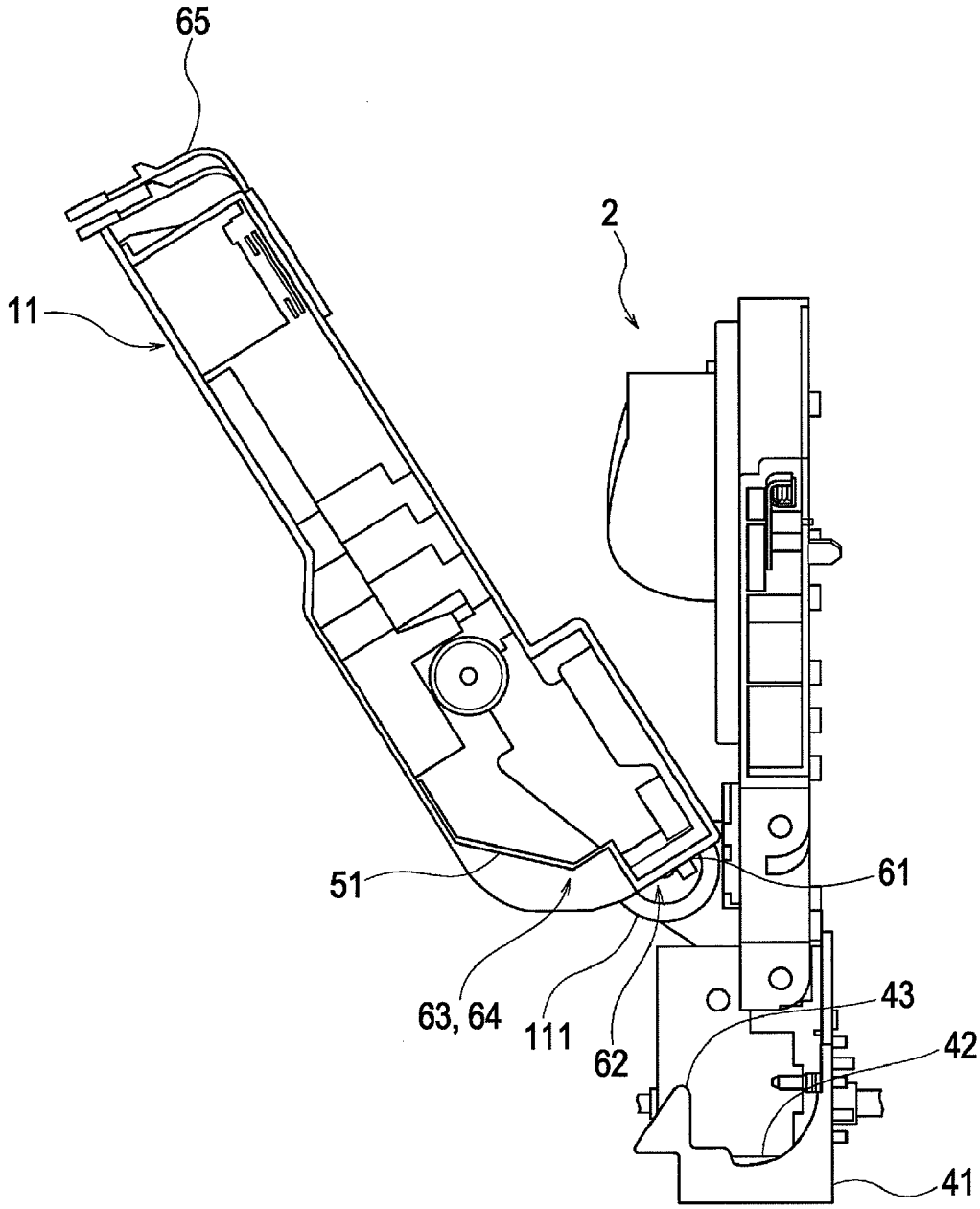
FIG. 12 is a vertical sectional view of the corresponding stage of mounting the reclaimed material container to the mounting portion of the image forming apparatus according to the exemplary embodiment of the present invention.
Figure 13:
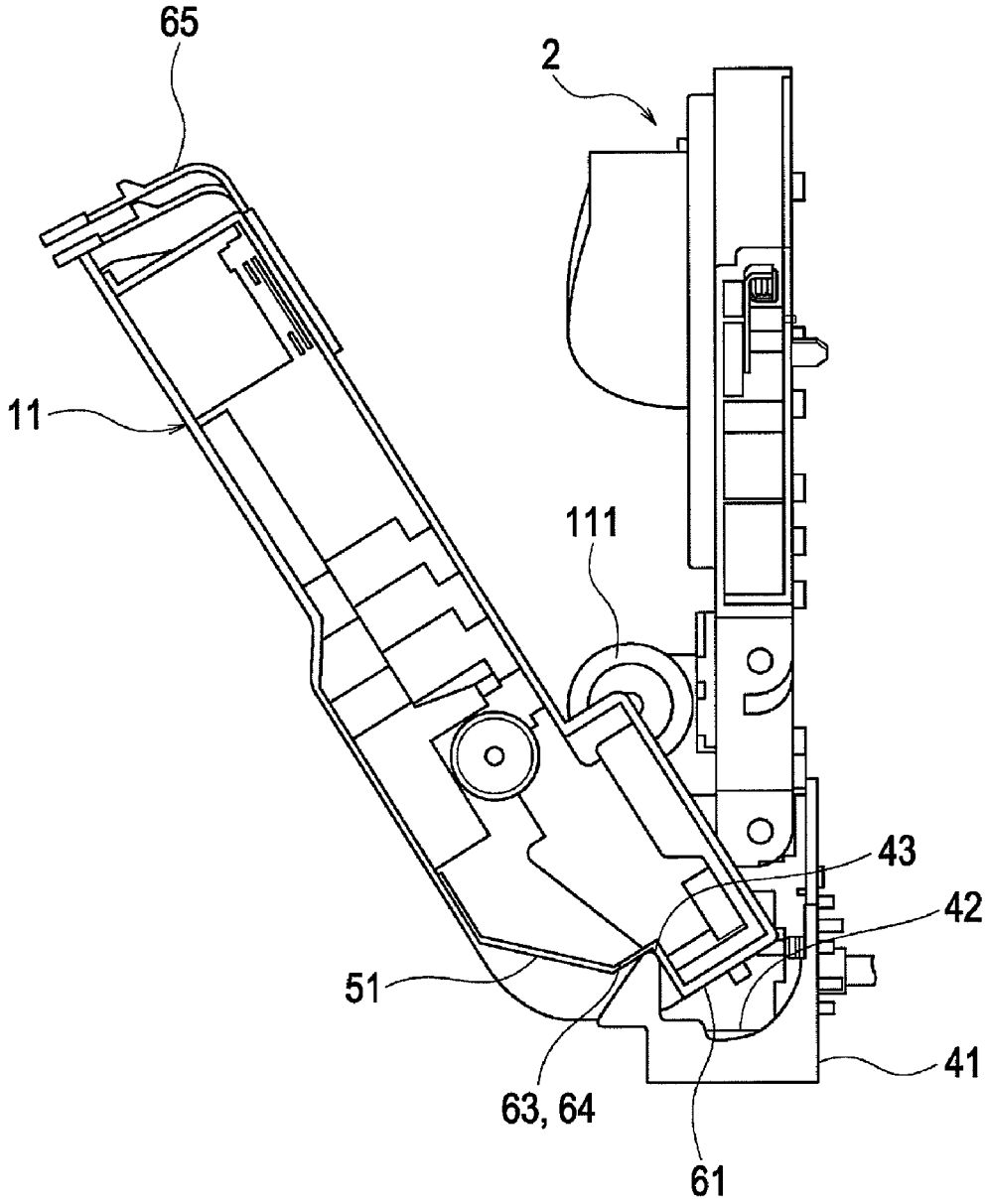
FIG. 13 is a vertical sectional view of the corresponding stage of mounting the reclaimed material container to the mounting portion of the image forming apparatus according to the exemplary embodiment of the present invention.
Figure 14:
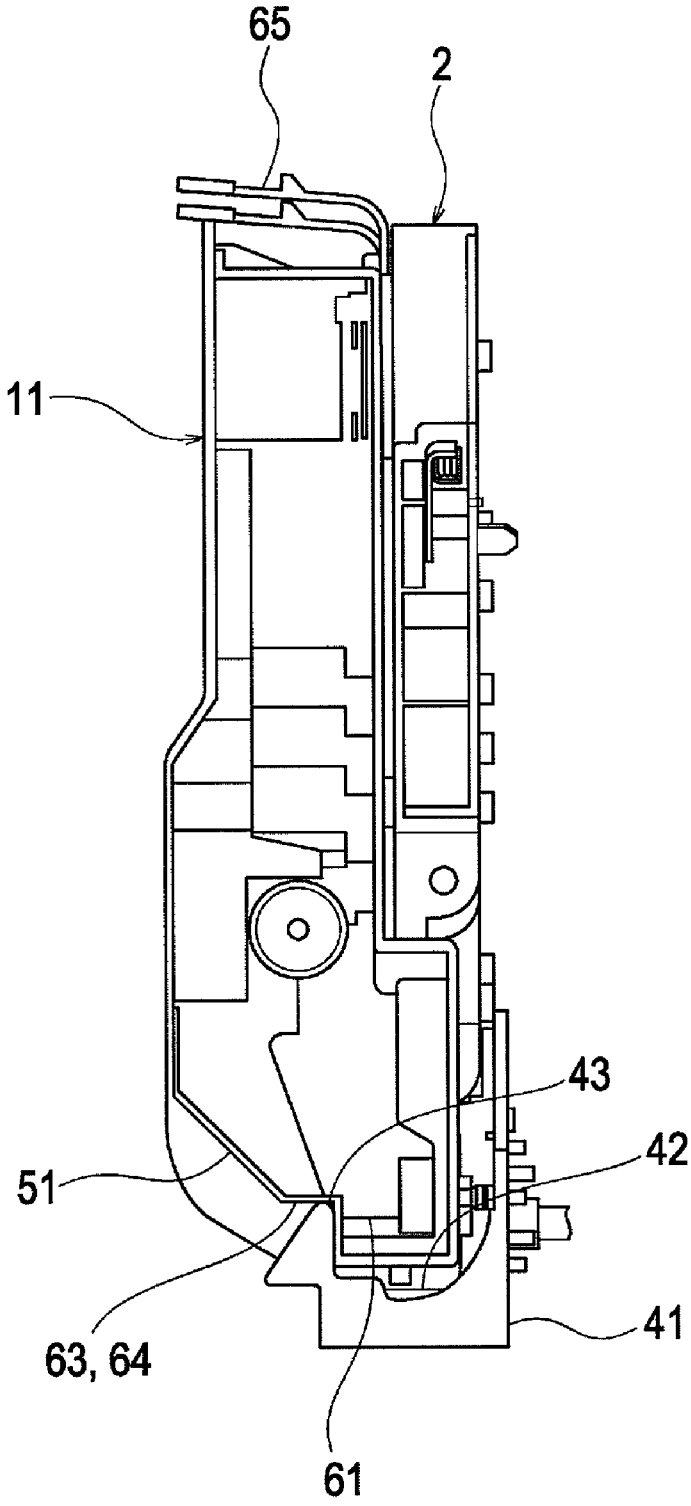
FIG. 14 is a vertical sectional view of the corresponding stage of mounting the reclaimed material container to the mounting portion of the image forming apparatus according to the exemplary embodiment of the present invention.

FIGS. 9 to 11 are perspective views showing stages of mounting the reclaimed material container 11 to the mounting portion 2. FIGS. 12 to 14 are vertical sectional views thereof.

When the mounting portion 2 is viewed from the front, the mounting portion 2 includes the pair of left and right supports 41 and the driving mechanism 111.

The reclaimed material container 11 is mounted to the mounting portion 2 as follows. First, the reclaimed material container 11 is obliquely tilted so that the upper portion of the reclaimed material container 11 is tilted towards the front with the bottom portion 61 being at the bottom, and an operator holds the reclaimed material container 11 so as to face the mounting portion 2 (see FIGS. 9 and 12).

Next, the operator lowers the reclaimed material container 11 from the bottom portion 61 towards the supports 41 of the mounting portion 2, so that the recesses 63 and 64 in the bottom portion 31 of the reclaimed material container 11 contact respective protruding portions 43 of the pair of supports 41 (see FIGS. 10 and 13).

Then, while the recesses 63 and 64 engage the pair of protruding portions 43 and the reclaimed material container 11 is supported by the supports 41 from therebelow, the reclaimed material container 11 is rotated with the recesses 63 and 64 as fulcra, and the reclaimed material container 11 is mounted to the mounting portion 2 by the pair of snap members 65 provided at the reclaimed material container 11 (see FIGS. 11 and 14). In this state, the bottom portion 61 is supported from therebelow by the bases 42 of the supports 41.

Accordingly, in mounting the reclaimed material container 11, the supports 41 and the recesses 63 and 64 are positioned with respect to each other. Here, the recesses 63 and 64 are positioned at the bottom portion 31 of the reclaimed material container 11. In order to position the supports 41 and the recesses 63 and 64 of the bottom portion 61 with respect to each other, the housing 13 gets in the way. Therefore, a field of view is infrequently provided for the operator.

Figure 15:
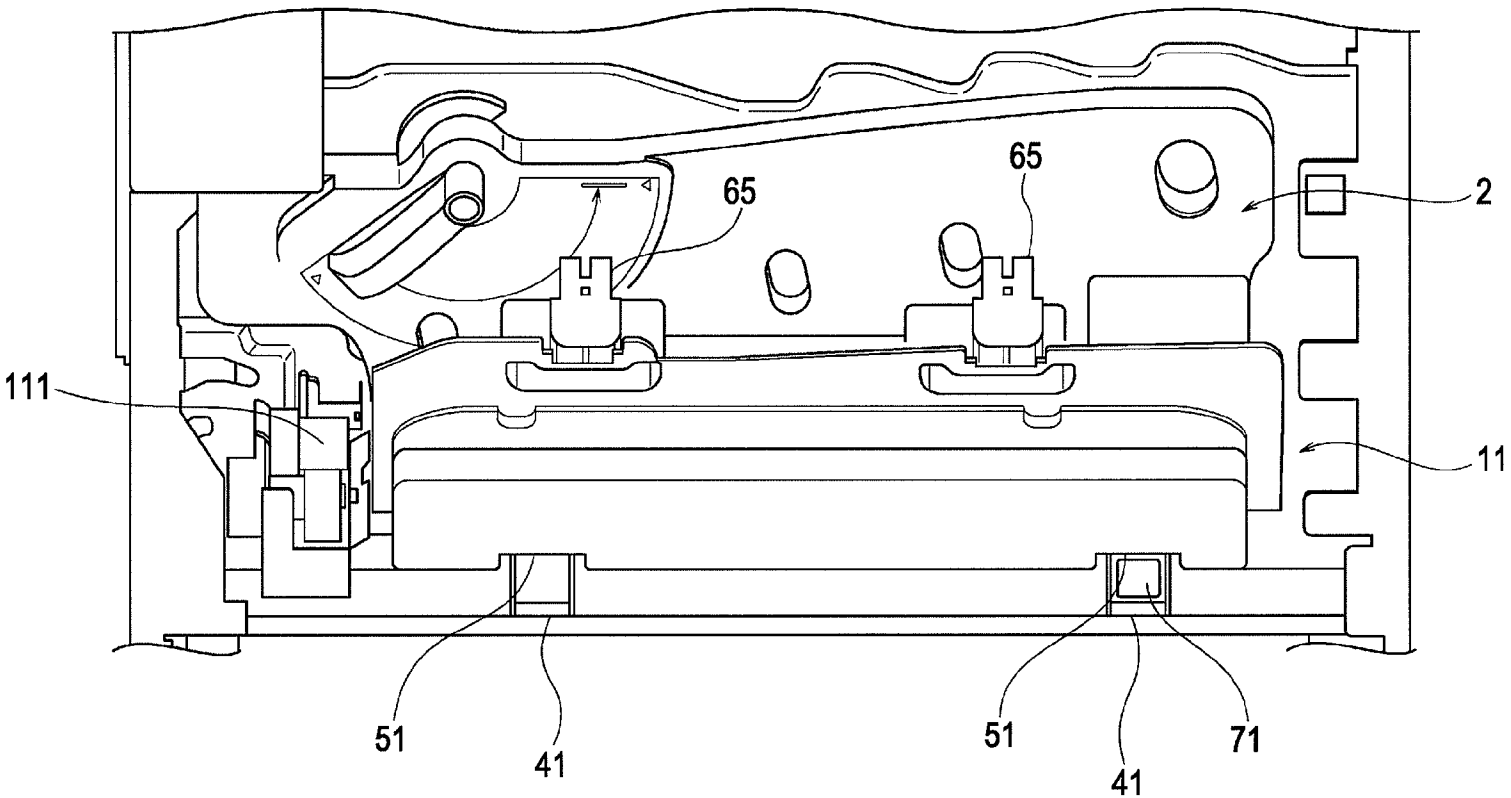
FIG. 15 shows the reclaimed material container and the mounting portion of the image forming apparatus according to the exemplary embodiment of the present invention as viewed from an operator.
Figure 16:
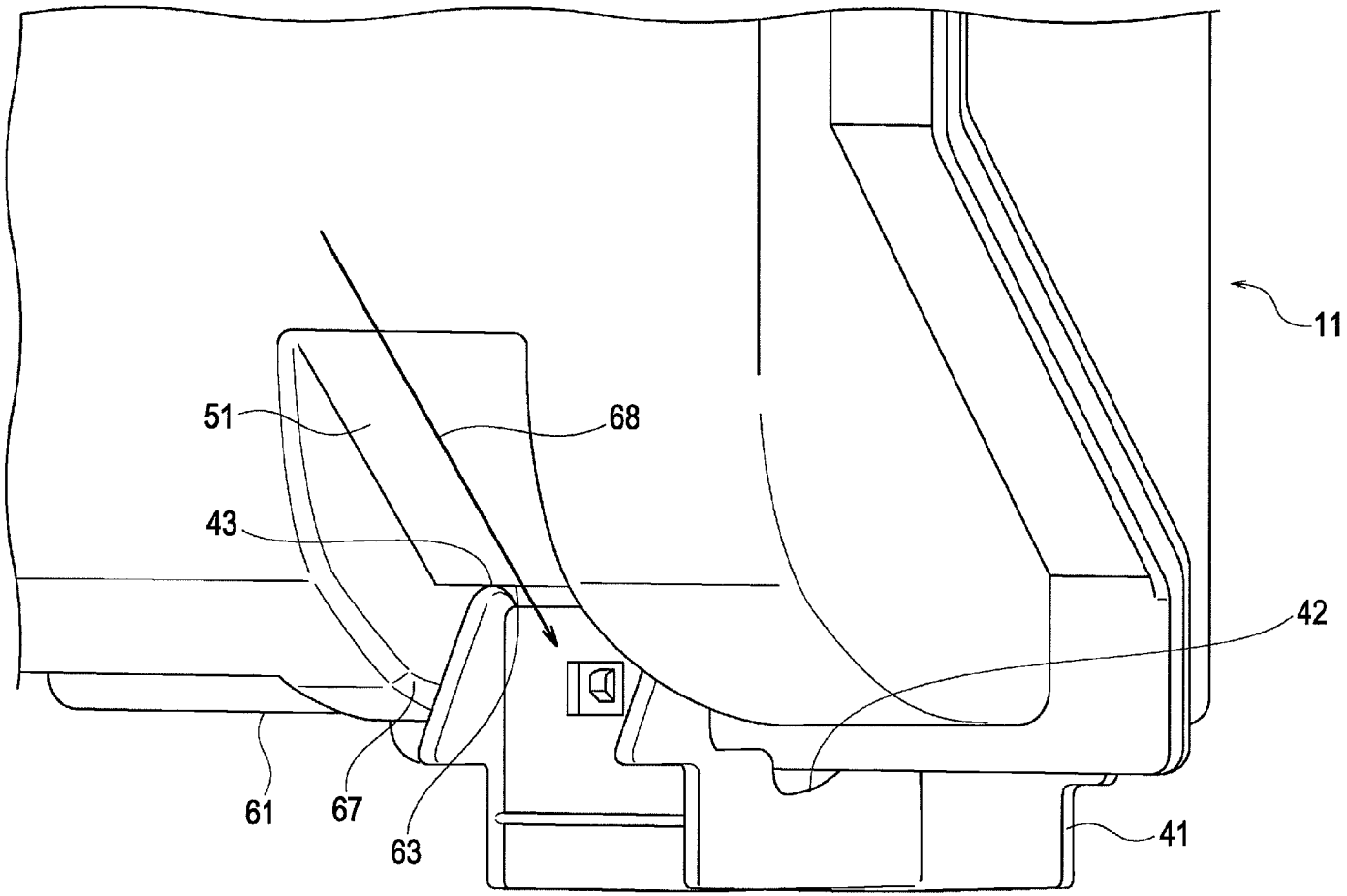
FIG. 16 is a partial enlarged perspective view of a receiving portion of the reclaimed material container and the support of the image forming apparatus according to the exemplary embodiment of the present invention.
Figure 17:
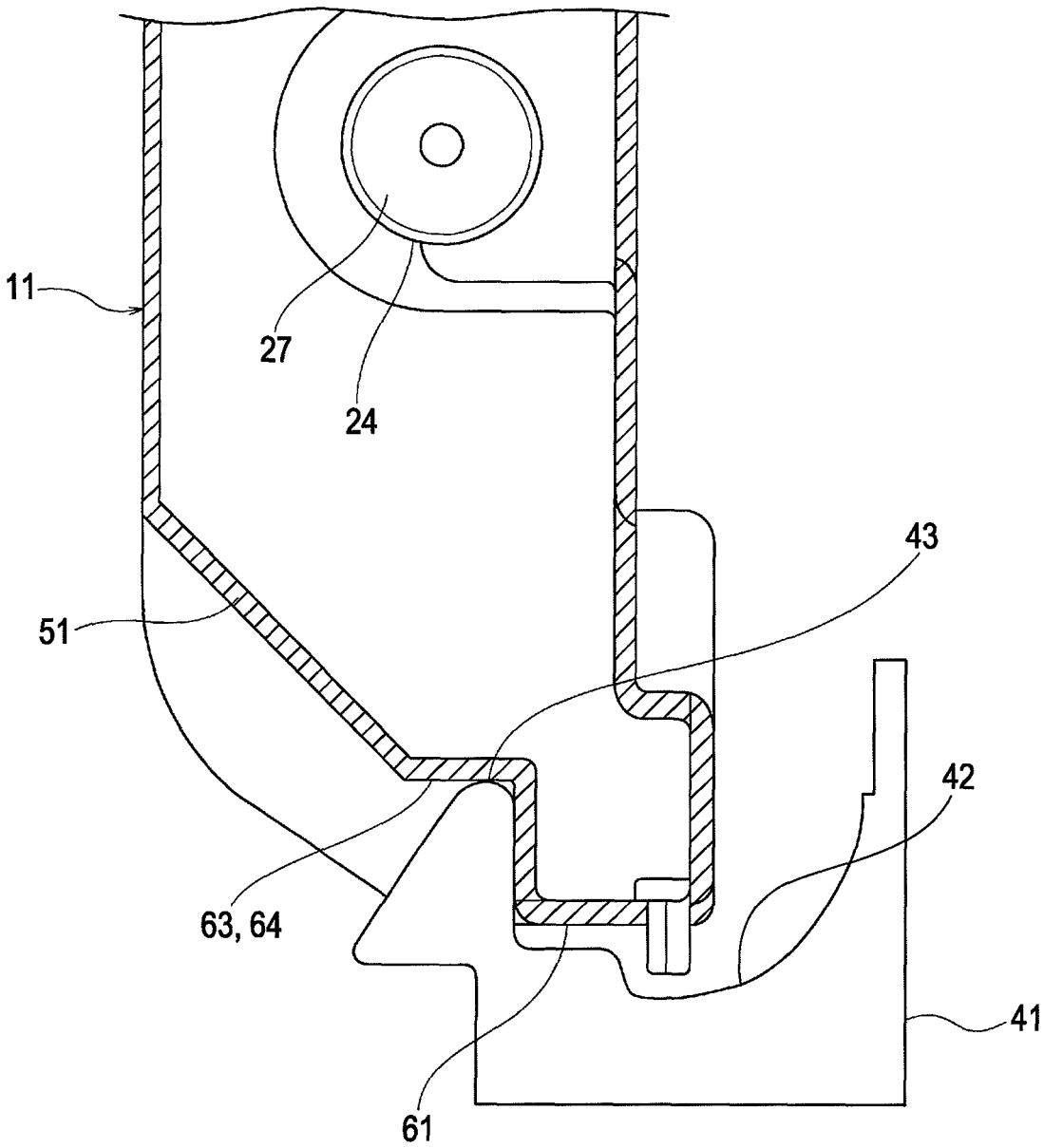
FIG. 17 is a vertical partial enlarged sectional view of the receiving portion of the reclaimed material container and the support of the image forming apparatus according to the exemplary embodiment of the present invention.
Figure 18:
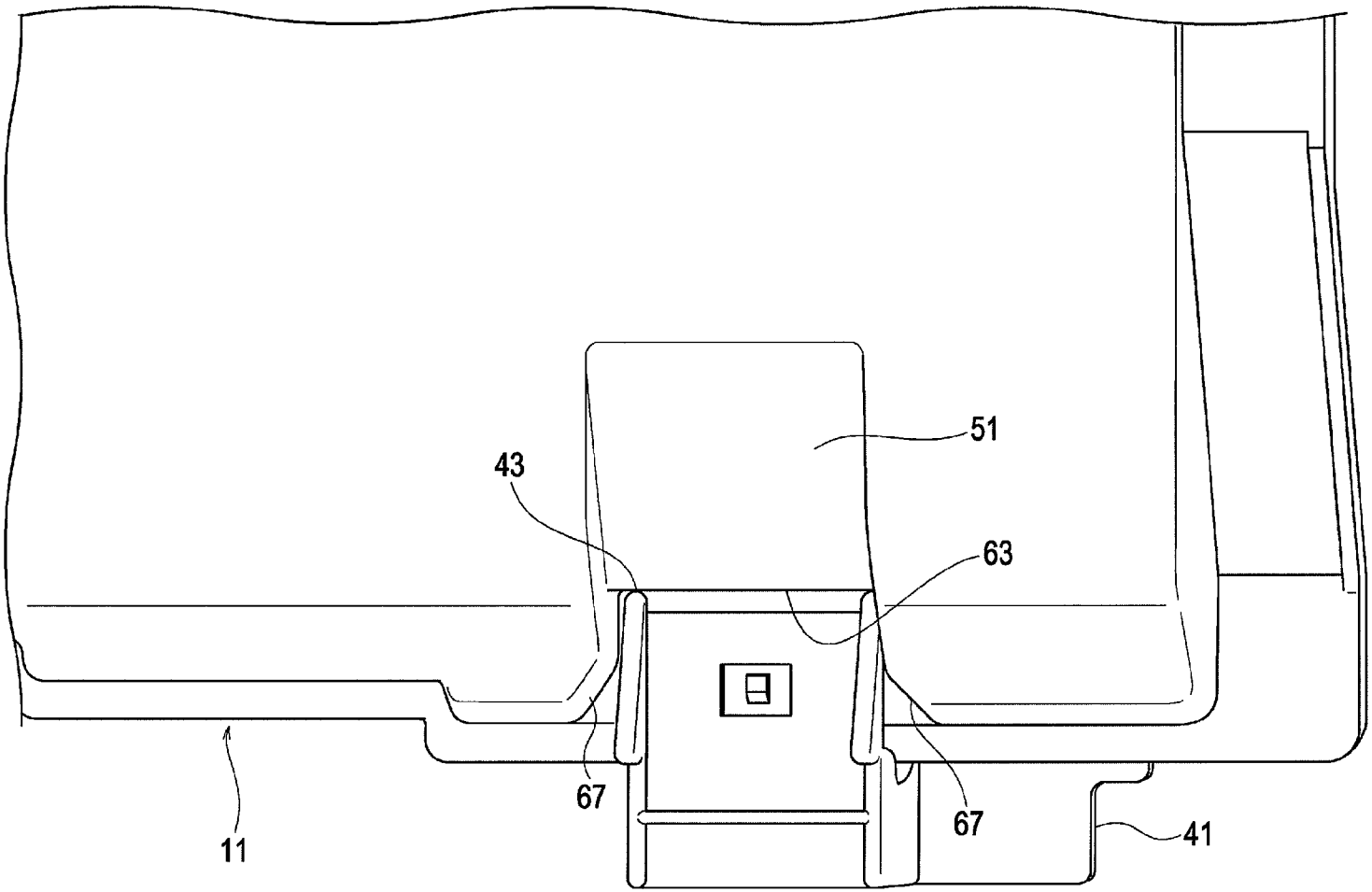
FIG. 18 is a partial enlarged perspective view of the receiving portion of the reclaimed material container and the support of the image forming apparatus according to the exemplary embodiment of the present invention.

Therefore, as shown in FIGS. 5 to 7, the vertical partial enlarged sectional view of FIG. 17, and the partial enlarged perspective view of FIG. 18, a pair of recesses 51 (serving as first recesses) are formed in the bottom portion 61 of the reclaimed material container 11 for making it easier to provide a field of view for the operator so as to allow the operator to see the positions of the supports 41, when the recesses 63 and 64 are supported from therebelow by the pair of protruding portions 43. As indicated by an arrow 68, it is possible to confirm that the receiving portions 62 are properly mounted to the supports 41 through the spaces provided by the recesses 51. FIG. 15 shows the reclaimed material container 11 and the mounting portion 2 as seen from the operator in the states shown in FIGS. 9 and 12.

As shown in FIG. 5, if a width A of the recess 63 and a width of the support 41 that receives the recess 63 are substantially equal to each other, and the recess 63 fits within the base 42 of the support 41, positioning in the widthwise direction of the recess 63 in the reclaimed material accommodation container 11 is performed.

However, since the width A of the recess 63 and the width of the support 41 are substantially the same, and there is little clearance width, the operator is incapable of easily manually guiding the recess 63 to the position of the support 41. Consequently, the recess 63 is substantially formed into a shape that is capable of easily receiving the support 41.

Accordingly, as shown in FIG. 5 and the perspective view of FIG. 18, for guiding the recess 63 to the position of the support 41, the recess 63 is such that the width of an entrance portion 67 for the support 41 is larger than the width A, and gradually becomes smaller towards the back. Accordingly, the recess 63 tapers.

As is clear from the foregoing description, the positioning of the reclaimed material container 11 in the widthwise direction in FIG. 4 is performed using the recess 63 and the right support 41 shown in FIG. 5. Therefore, if the recess 63 and the right support 41 shown in FIG. 5 are positioned with respect to each other, the position of the reclaimed material container 11 in the widthwise direction is determined. Therefore, the recess 64 is formed so that it is capable of easily being mounted without precisely positioning it with respect to the left support 41 shown in FIG. 5.

Accordingly, as shown in FIG. 5, a width B of the recess 64 is made larger than the width A of the recess 63, so that a large clearance is provided by the recess 64.

Considering the recess 63 and the right support 41 shown in FIG. 5, the positioning of the reclaimed material container 11 in the widthwise direction shown in FIG. 5 is precisely performed when a positioning member for positioning of the reclaimed material container 11 in the widthwise direction shown in FIG. 5 is also provided at the right support 41 shown in FIG. 5.

Figure 19:
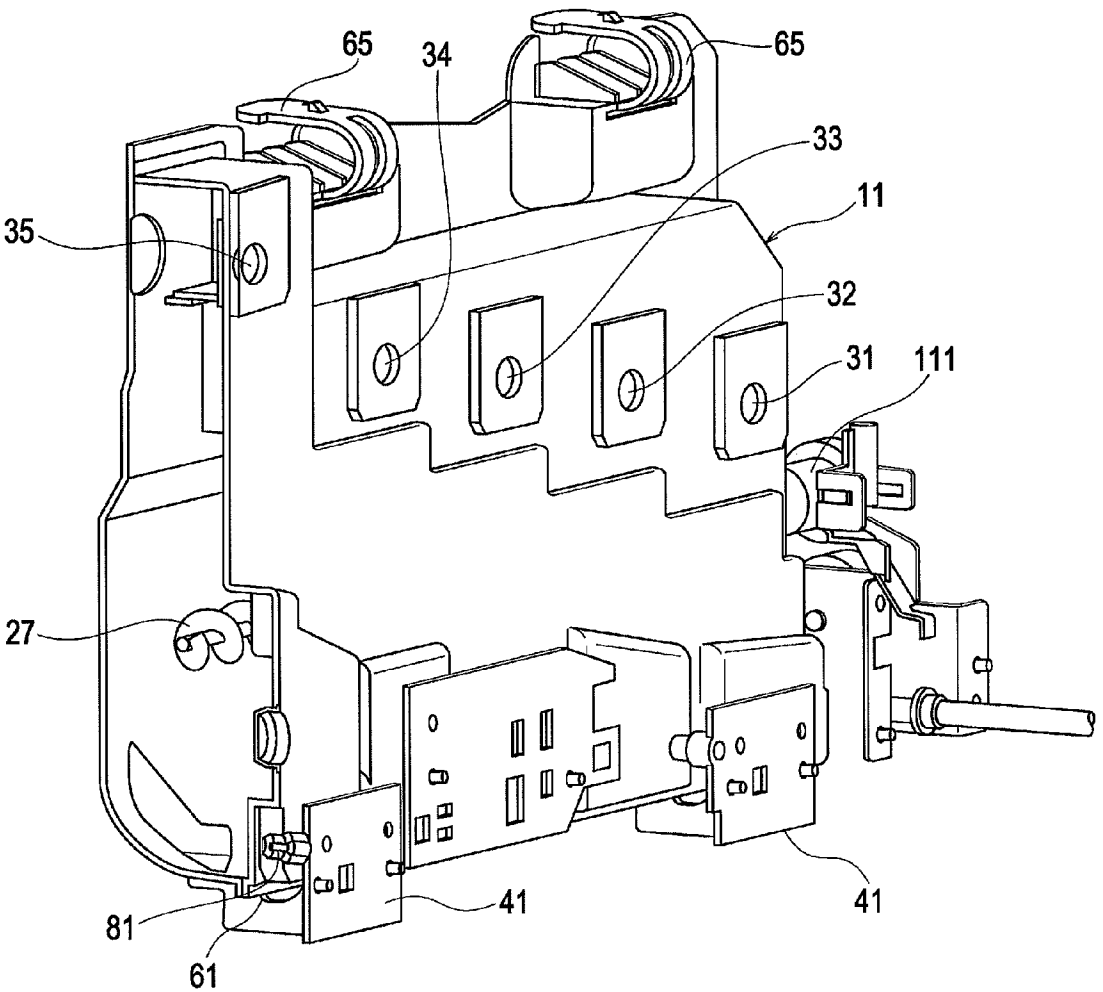
FIG. 19 is a vertical perspective rear view of the reclaimed material container according to the exemplary embodiment of the present invention.

As shown in the vertical perspective rear view of the reclaimed material container 11 of FIG. 19, a positioning member 71 that positions the reclaimed material container 11 in the widthwise direction shown in FIG. 5 is provided at the right support 41 shown in FIG. 5.

In addition, the operator is capable of easily visually perceiving that, of the left and right supports 41, it is the right support 41 shown in FIG. 5 that is used for positioning the reclaimed material container 11 in the widthwise direction shown in FIG. 5.

Therefore, as is clear from FIGS. 9 to 11 and FIG. 15, a seal 81 is stuck on the front surface of the right support 41 of the pair of left and right supports 41, whereas a seal is not stuck on the front surface of the left support 41 of the pair of left and right supports 41.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A reclaimed material container comprising:

a container body that is removably mounted to a mounting portion of an image forming apparatus, and that accommodates a reclaimed material existing after forming an image;

a receiving portion that is provided at a bottom portion of the container body, and that is supported by a support of the mounting portion from therebelow; and a mounting member that mounts the container body to the mounting portion as a result of rotation of the container body with the receiving portion as a fulcrum while the receiving portion is supported by the support from therebelow, wherein the container body has a first recess that provides a field of view for the support when the receiving portion is supported by the support from therebelow.

2. The reclaimed material container according to claim 1, wherein, when viewed from a mounting side of the container body to the mounting portion, a pair of the receiving portions are provided, one on the left and one on the right in relation to each other, and a pair of the supports are provided, one on the left and one on the right in relation to each other, wherein one of the pair of left and right receiving portions has a second recess that engages the corresponding support, and wherein the second recess of the one of the receiving portions has a width that is wider at an entrance for the support than at a back side thereof so as to make it easier to receive the support.

3. The reclaimed material container according to claim 2, wherein the other receiving portion has a second recess whose width is larger than the width of the second recess of the one of the receiving portions so that a clearance in a direction of the width is large.

4. The reclaimed material container according to claim 2, further comprising a positioning member that is provided at the support that supports the one of the receiving portions from therebelow, and that performs positioning in a direction of the width of the second recess in the container body when the receiving portion is supported by the support from therebelow.

5. The reclaimed material container according to claim 3, further comprising a positioning member that is provided at the support that supports the one of the receiving portions from therebelow, and that performs positioning in the direction of width of the second recess in the container body when the receiving portion is supported by the support from therebelow.

6. An image forming apparatus comprising:

an image forming unit that forms an image by an electrophotographic system;

a mounting portion that includes a support; and a reclaimed material container that is removably mounted to the mounting portion, and that accommodates a reclaimed material existing after forming an image by the image forming unit, wherein the reclaimed material container includes a container body that accommodates the reclaimed material;

a receiving portion that is provided at a bottom portion of the container body, and that is supported by the support of the mounting portion from therebelow; and a mounting member that mounts the container body to the mounting portion as a result of rotation of the container body with the receiving portion as a fulcrum while the receiving portion is supported by the support from therebelow, wherein the container body has a first recess that provides a field of view for the support and the receiving portion when the container body is rotated while the receiving portion is supported by the support from therebelow.

* * * * *